US006499330B1

(12) United States Patent
Pelech, Jr.

(10) Patent No.: US 6,499,330 B1
(45) Date of Patent: Dec. 31, 2002

(54) DISPLACEMENT INDICATOR DEVICE FOR A PRESS BRAKE COMPENSATOR

(76) Inventor: Bruno J. Pelech, Jr., 17350 Antler Dr., Orland Park, IL (US) 60467

( * ) Notice: Subject to any disclaimer, the term of this patent is extended or adjusted under 35 U.S.C. 154(b) by 0 days.

(21) Appl. No.: 09/658,647

(22) Filed: Sep. 11, 2000

(51) Int. Cl.[7] ..... B21D 5/02; B21D 9/05
(52) U.S. Cl. ..... 72/389.4; 72/482.4
(58) Field of Search ..... 72/389.4, 389.5, 72/482.1, 482.4, 465.1

(56) References Cited

U.S. PATENT DOCUMENTS

| | | | | | |
|---|---|---|---|---|---|
| 4,426,873 | A | * | 1/1984 | Pearson et al. | 72/389.4 |
| 4,449,389 | A | * | 5/1984 | Cros | 72/389.4 |
| 4,736,612 | A | * | 4/1988 | Russell | 72/389.4 |
| 4,898,015 | A | * | 2/1990 | Houston | 72/389.4 |
| 6,164,114 | A | * | 12/2000 | Pelech, Jr. | 72/389.4 |

* cited by examiner

*Primary Examiner*—David Jones
(74) *Attorney, Agent, or Firm*—Cherskov & Flaynik

(57) ABSTRACT

A displacement indicator device 10 for a press brake compensator 16 includes a first recess 20 in a lower wall of a preselected portion or a die holder member 14 of the press brake compensator 16, an indicator rod 18 snugly inserted into the first recess 20, a second recess 34 in a side wall 36 of a preselected portion of a wedge portion 38 of the press brake compensator 16, and a lifting cam 40 snugly inserted into the second recess 34. The indicator rod 18 is displaced by the movement of the preselected portion of the wedge portion 38. The indicator rod 18 displacement corresponds to the vertical displacement of the die holder member 14. An indicating scale 32 discloses the amount of displacement of the preselected portion of the die holder member 14 by aligning a reference mark 28 on the indicator rod 18 with a horizontal line and corresponding number on the indicating scale 32. The measuring of the vertical displacement of the die holder member 14, is ultimately used for the fast set-up of the press brake compensator 16 when a press brake is utilized to duplicate bends impressed upon substantially identical workpieces.

20 Claims, 8 Drawing Sheets

DISPLACEMENT INDICATOR DEVICE FOR A PRESS BRAKE COMPENSATOR

BACKGROUND OF THE INVENTION

1. Field of the Invention

The present invention relates generally to press brake compensators and, more particularly, to devices that indicate the vertical elevation of preselected portions of a die holder member of the press brake compensator.

2. Background of the Prior Art

It is common practice to use press brake compensators between a die and a press bed of a press brake to vary the crown or elevation of the die to obtain consistent bends and angles such that end and mid-portions of a workpiece have the same configurations after the workpiece is bent by a press brake. The press brake compensator is required to compensate for the downward deflection or "yawning" in the press bed of the press brake caused by excessive use and operating loads. Further, the design of the press brake will influence workpiece inconsistencies and form an incomplete bend or "flat spot" due to deflection of the press bed. The greater the longitudinal dimension of the press bed, the greater the downward deflection in the press bed and the more pronounced the flat spots in the workpiece after operation of the press brake.

It is also common practice to use indicator devices to determine the vertical distance of travel of preselected portions of the press brake compensator when configuring a workpiece. Knowing the distance of travel, provides for a fast set-up of a press brake when adjusted to repeat a configuration for a substantially identical workpiece. Prior art devices utilize indicator pins to indicate the relative adjusted position of a corresponding wedge member. An example of this technique is disclosed in U.S. Pat. No. 4,736,612. The patent teaches the use of horizontal pins to disclose the relative horizontal position of a wedge member. Other prior art devices utilize an indicating gauge in a displacement handle; the handle horizontally moving a wedge member that elevates a die holder member. An example of such a device is disclosed in U.S. Pat. No. 4,898,015.

The problem with this method of indication is that no accurate measurement is taken of the horizontal movement of the indicator pin. Further, no relationship is considered between the horizontal movement of the indicator pin and the vertical displacement of the wedge member. Thus, the press brake compensator cannot be quickly set-up by using measured component displacement to duplicate a prior configuration impressed upon a routine workpiece.

Another method of determining the vertical displacement of a press brake compensator to accomplish a fast set-up, is for a person to physically measure the vertical separation between a die holder member and a press bed engagement member of the press brake compensator. Although the measurement will be accurate, the time spent by the operator to obtain the measurement is excessive and costly which is increased should more than one portion of the press brake compensator need to be measured.

A need exists for a press brake compensator displacement indicator that measures the vertical displacement of a preselected portion of a die holder member of the compensator to provide for the fast set-up of the compensator whenever duplicated bends for multiple workpieces are provided by a press brake.

SUMMARY OF THE INVENTION

It is an object of the present invention to provide a displacement indicator device for a press brake compensator. It is an object of the present invention to overcome many of the disadvantages of the prior art.

A principle object of the present invention is to provide a device that indicates the vertical elevation of a preselected portion of a press brake compensator. A feature of the device is an indicator rod positioned at the preselected portion of the press brake compensator; the indicator rod having a circumscribed radial reference mark. Another feature of the device is an indicating scale positioned adjacent to the indicator rod. An advantage of the device is that the vertical elevation of the preselected portion of the press brake compensator is readily determined by a person viewing the reference mark and a corresponding line and number on the scale.

Another object of the present invention is to provide a device that enables a person operating the press brake compensator to easily view a substantial longitudinal portion of the indicator rod. A feature of the device is a first recess or aperture positioned adjacent to a first side wall of a die holder member of the press brake compensator, the aperture extending vertically through the die holder member and snugly receiving the indicator rod. Another feature of the device is an elliptically configured viewing aperture that integrally joins with the first aperture. An advantage of the device is that a person operating the press brake compensator can easily find the reference mark on the indicator rod.

Still another object of the present invention is to provide a device that includes an indicating component that moves vertically in response to the horizontal movement of a wedge portion of the press brake compensator. A feature of the device is a second recess positioned in a side wall of the wedge portion. Another feature of the device is a lifting cam snugly inserted in the second recess. An advantage of the device is that the lifting cam moves the indicator rod vertically as the wedge portion is moved horizontally.

Yet another object of the present invention is to provide a device that includes an indicating component that moves a vertical distance equal to the horizontal distance the wedge portion moves. A feature of the device is an inclined end wall of the lifting cam; the end wall having a slope of forty-five degrees. An advantage of the device is that the indicating scale can be easily calibrated to provide the vertical displacement of the die holder member by aligning the reference mark of the indicator rod with the horizontal lines of the indicating scale when the slope of the wedge portion is not forty-five degrees.

Another object of the present invention is to provide a device having unrestricted engagement between moving components. A feature of the device is the indicator rod having a chamfered bottom wall that is ultimately engaged by a lower edge portion of the lifting cam. An advantage of the device is that the lifting cam easily lifts the indicator rod off a ledge of a press bed engagement member of the press brake compensator.

A further object of the present invention is to provide a device having an indicating range that corresponds to the maximum elevation of the die holder member of the press brake compensator. A feature of the device is an aperture in a first arm member of the press bed engagement member of the press brake compensator. An advantage of the device is that the lifting cam is capable of being moved horizontally through the aperture until the first arm member restricts further movement of the wedge portion thereby preventing further elevation of the corresponding portion of the die holder member.

Briefly, the invention provides a displacement indicator device for a press brake compensator comprising a first recess in a lower wall of a preselected portion of a die holder member of the press brake compensator; an indicator rod snugly inserted into said first recess; a second recess in a side wall of a preselected portion of a wedge portion of the press brake. compensator; a lifting cam snugly inserted into said second recess; means for displacing said indicator rod correspondingly to the displacement of said preselected portion of the wedge portion of the press brake compensator, and means for indicating the quantity of displacement of said preselected portion of the die holder member of the press brake compensator via the displacement of said indicator rod.

BRIEF DESCRIPTION OF THE DRAWINGS

The foregoing invention and its advantages may be readily appreciated from the following detailed description of the preferred embodiment, when read in conjunction with the accompanying drawings in which.

DESCRIPTION OF THE PREFERRED EMBODIMENT

Figure 1:
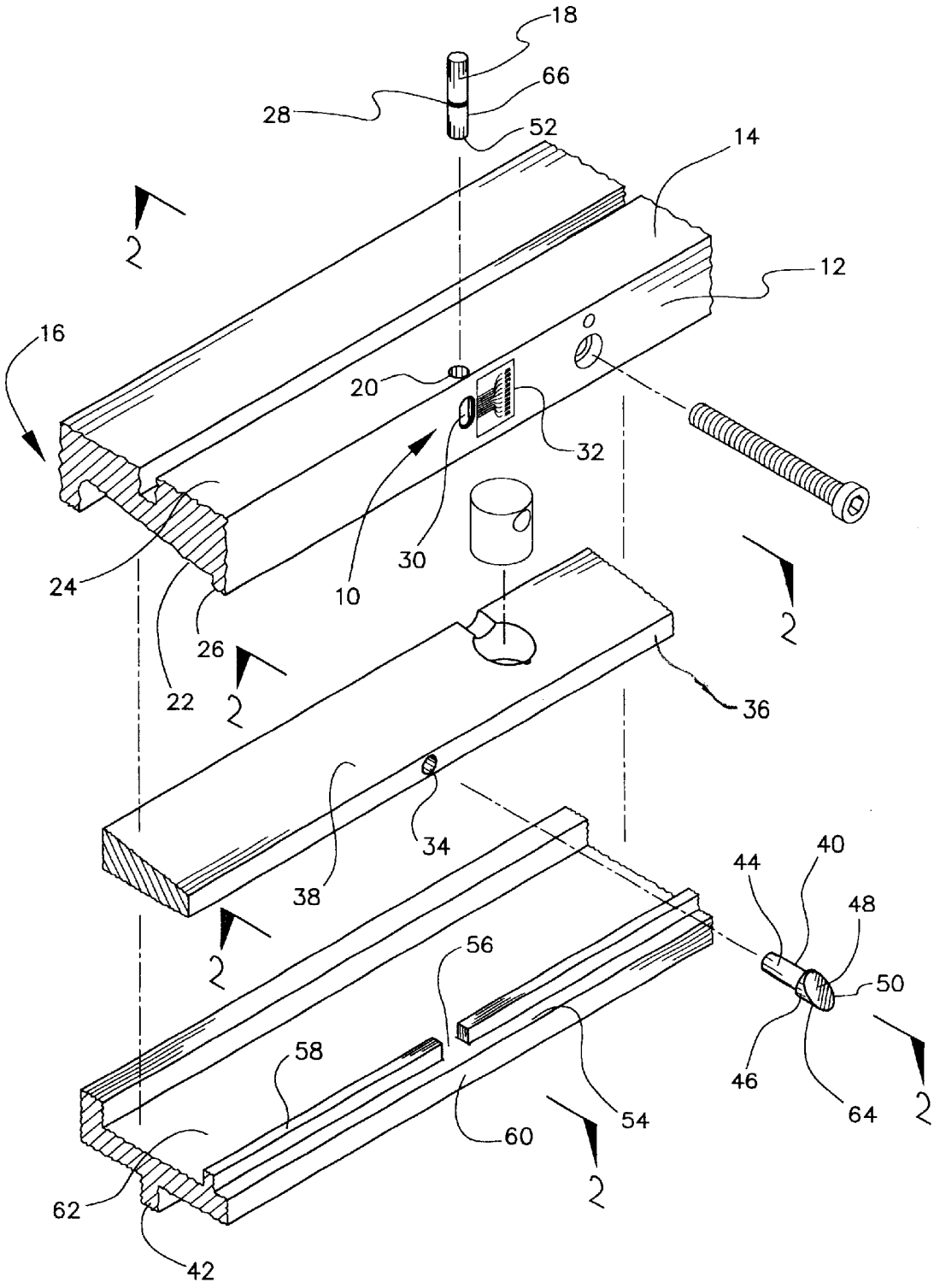
FIG. 1 is an exploded perspective view of a displacement indicator device for a press brake compensator in accordance with the present invention.
Figure 4:
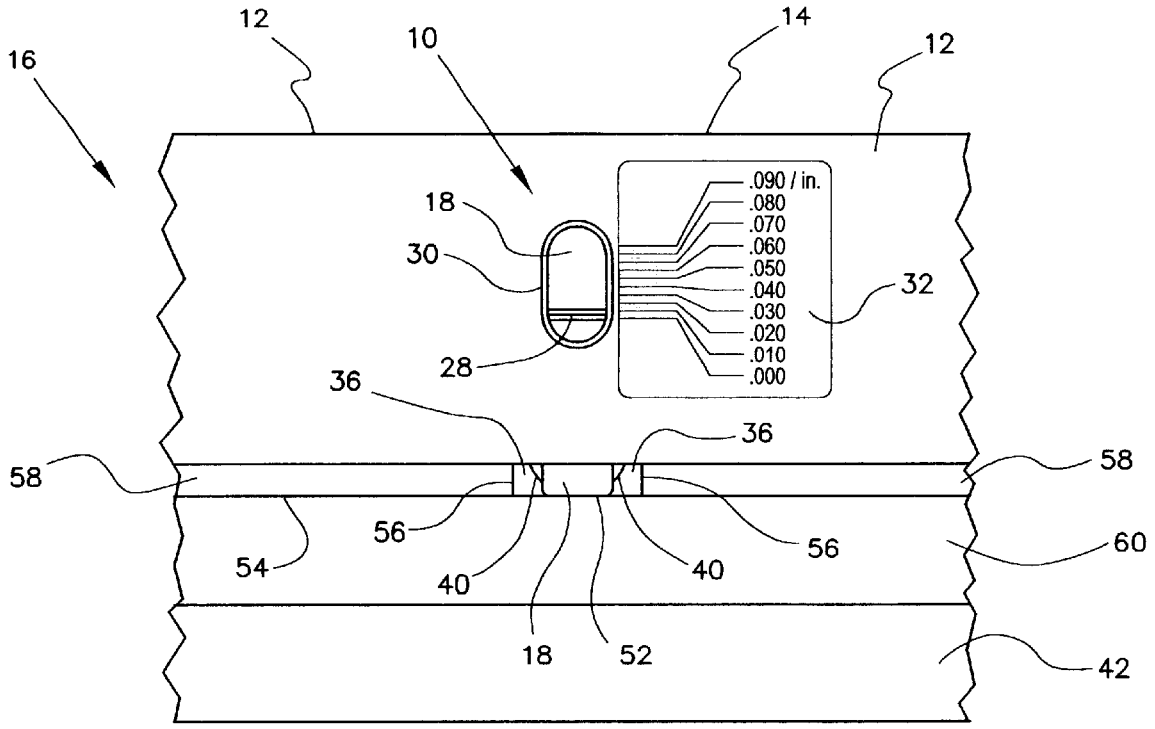
FIG. 4 is a front elevation view of the device depicted in FIG. 2, the device being in a non-displaced position.
Figure 5:
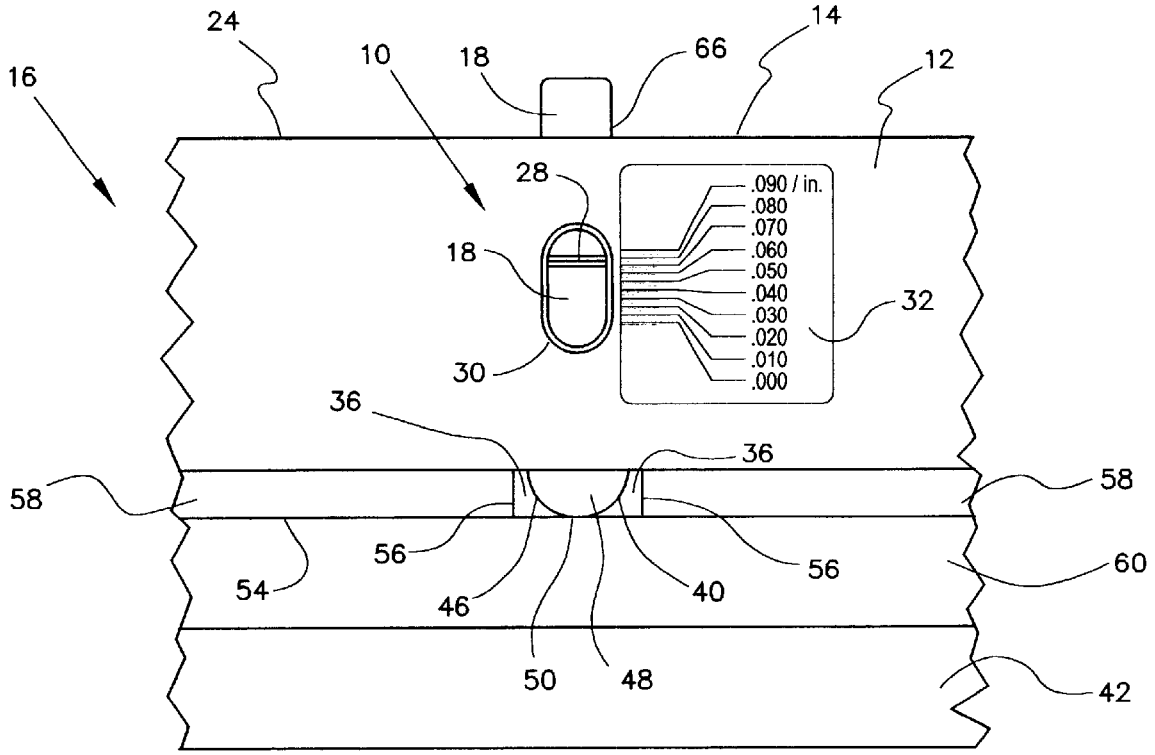
FIG. 5 is a front elevation view of the device depicted in FIG. 3, the device being in a displaced position.

Referring now the figures and particular to FIGS. 1, 4 and 5, an exploded perspective view, and front views of a displacement indicator device for a press brake compensator in accordance with the present invention is denoted by numeral 10. The displacement indicator device 10 may be utilized with a myriad of press brake compensator designs, however, to simply the description, the applicant is incorporating herein by reference his U.S. Patent Application for a Press Brake Compensator Device, application number 09/413,913, filing date Oct. 4, 1999. In FIG. 1, the displacement indicator device 10 is positioned proximate to the longitudinally mid-portion and first side wall 12 of the of the die holder member 14 of the press brake compensator 16. The location of the device 10 in FIG. 1 should not be read as limiting the positioning or quantity of devices 10 that might be used with any press brake compensator 16.

Figure 9:
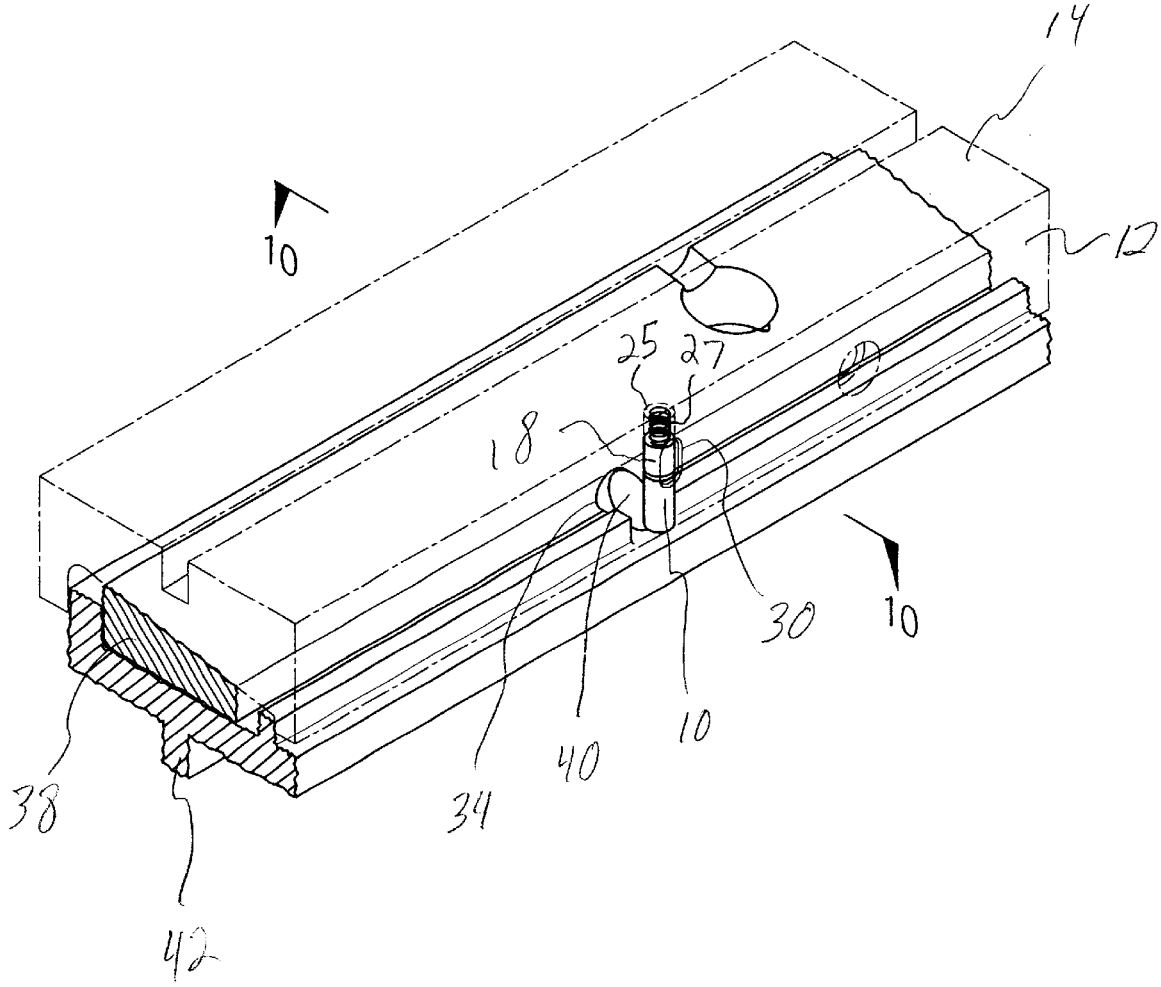
FIG. 9 is the perspective view of FIG. 7 but with the indicator rod aperture replaced by a recess that receives a spring and the indicator rod therein in accordance with the present invention.
Figure 10:
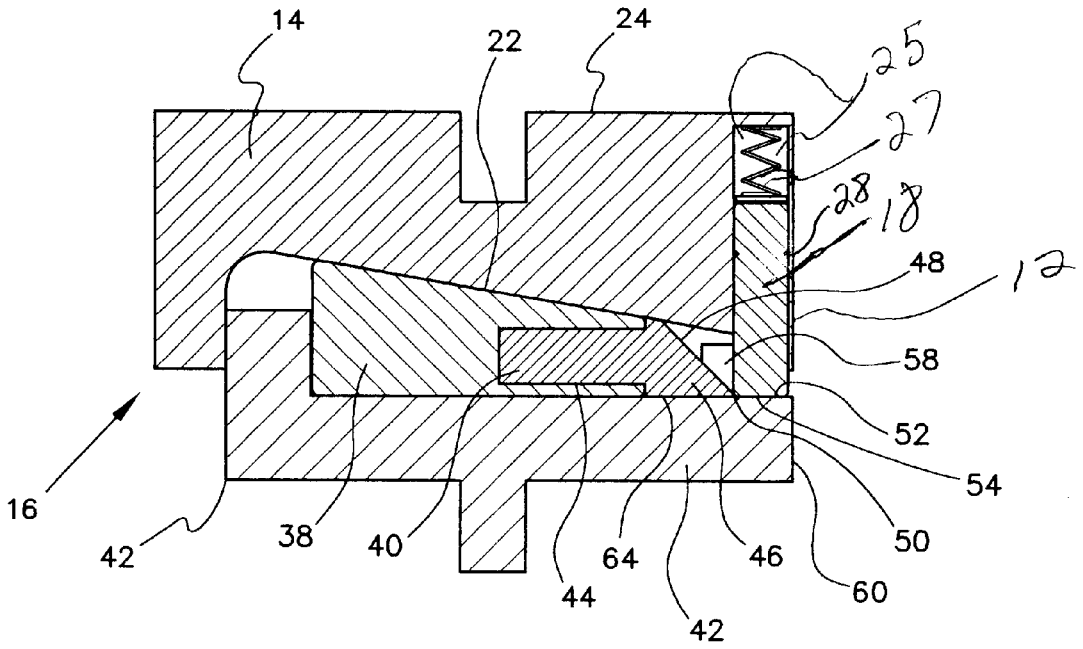
FIG. 10 is the sectional view of FIG. 2 but with the indicator rod aperture replaced by a recess that receives a spring and the indicator rod therein.
Figure 11:
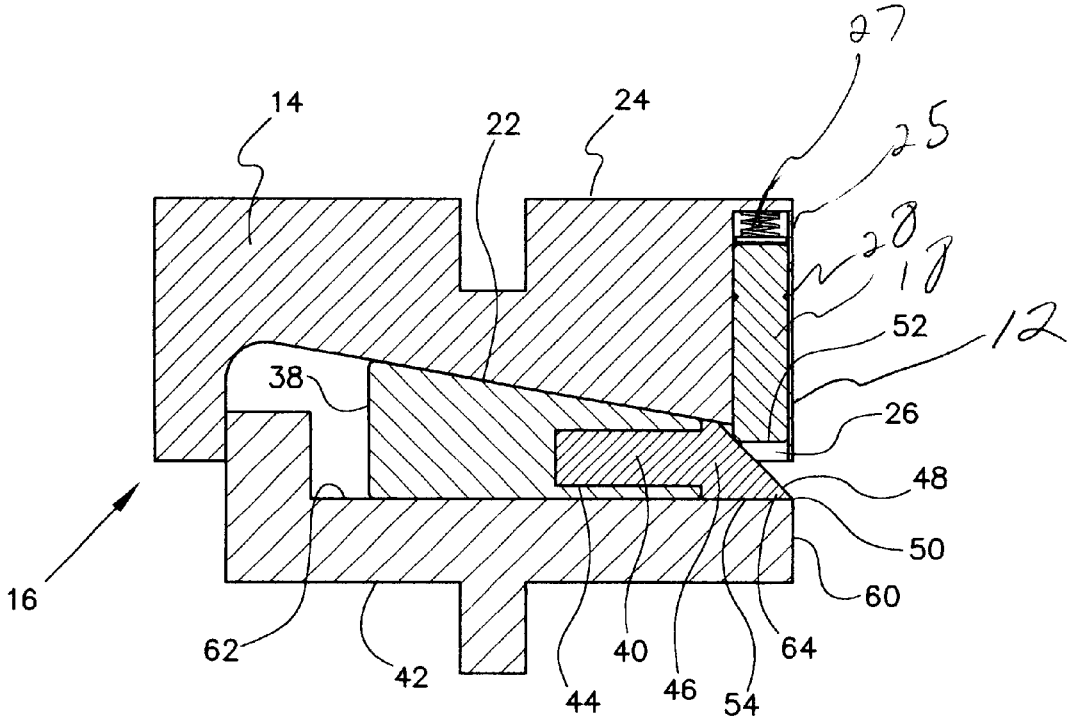
FIG. 11 is the sectional view of FIG. 3 but with the indicator rod aperture replaced by a recess that receives a spring and the indicator rod therein.

The displacement indicator device 10 includes a cylindrical indicator rod 18 that snugly inserts into a first cylindrical aperture 20 that extends from lower to upper walls 22 and 24 of the die holder member 14. The first aperture 20 is positioned adjacent to the first side wall 12 of the die holder member 14 via an oval configured recess 21 (see FIG. 6) in an inner arm member 26, such that the longitudinal axis of the first aperture 20 is parallel to the first side wall 12 and perpendicular to the lower and upper walls 22 and 24. A first recess 25 (see FIGS. 9–11) may substitute for the first aperture 20 in the lower wall 22 thus allowing a spring 27 to be inserted into the recess 25 such that the indicator rod 18 is biased downward thereby forcibly engaging the upper wall 62 of the press bed engagement member 42. The indicator rod 18 includes a radial reference mark 28 that circumscribes the rod 18 at substantially a longitudinal mid-portion of the rod 18. An elliptical viewing aperture 30 is positioned in the first side wall 12 of the die holder member 14. The viewing aperture 30 cooperates with the first aperture 20 to allow a person to view the indicator rod 18 and the reference mark 28 thereon as the rod 18 is displaced within the first aperture 20. An indicating scale 32 is secured to the first side wall 12 adjacent to the viewing aperture 30 to provide the displacement of the corresponding portion of the die holder member 14 of the press brake compensator 16 when the press brake compensator 16 is adjusted. The indicating scale 32 is numbered in units of hundredths of an inch.

The displacement indicator device 10 further includes a second recess 34 in a side wall 36 of a preselected mid-portion of a wedge portion 38 of the press brake compensator 16. A lifting cam 40 is snugly inserted into the second recess 34 to ultimately engage and vertically displace the indicator rod 18 when the wedge portion 38 is horizontal displaced in a press bed engagement member 42 of the press brake compensator 16. The lifting cam 40 includes a cylindrical first portion 44 inserted in the second recess 34, and a relatively larger cylindrical second portion 46 having an inclined end wall 48. The inclined end wall 48 forms an angle of substantially about forty-five degrees with the longitudinal axis of the lifting cam 40.

Figure 2:
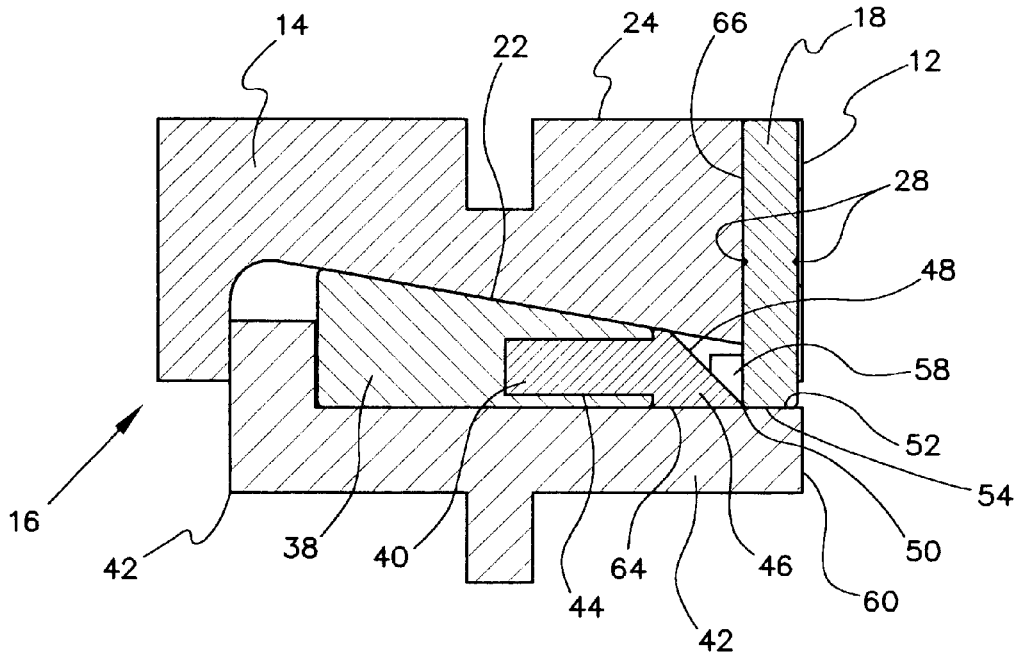
FIG. 2 is a sectional view of the device taken along line 2—2 of FIG. 1, the device being in a non-displaced position.
Figure 3:
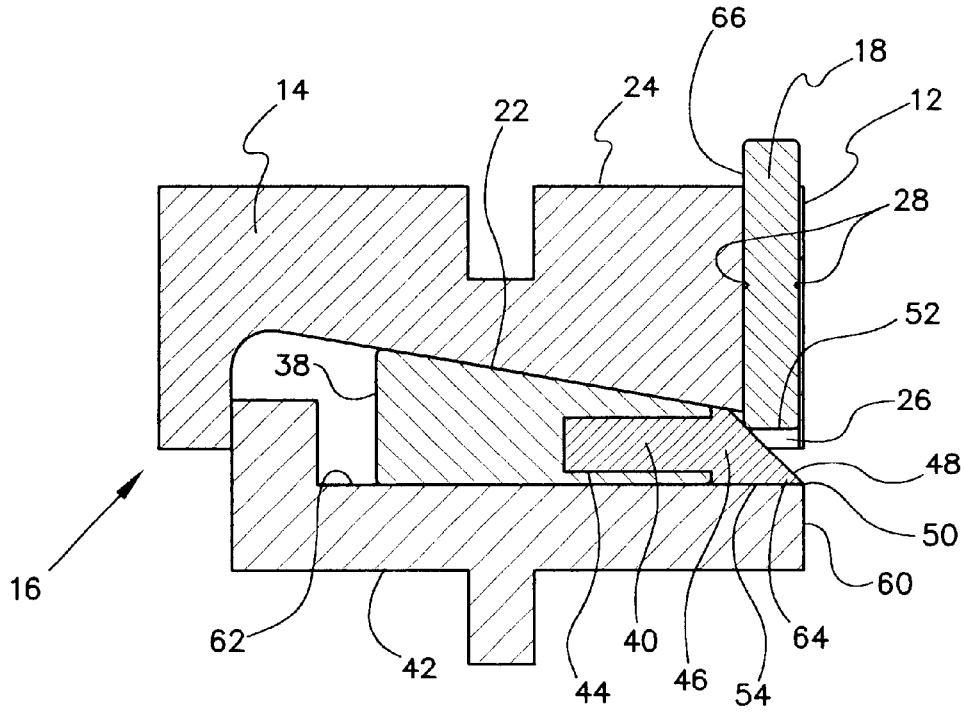
FIG. 3 is a sectional view of the device depicted in FIG. 2, the device being in a displaced position.

Referring now to FIGS. 2 and 3, sectional views of the displacement indicator device 10 in the press brake compensator 16 with the indicator rod 18 shown in elevated and non-elevated positions, are depicted. When the indicator rod 18 is in the non-elevated position (FIG. 2), a horizontally extending lower edge portion 50 of the lifting cam 40 is adjacent to a chamfered bottom wall 52 of the indicator rod 18 which engages a ledge 54 of the press bed engagement member 42. In the elevated position (FIG. 3), the configuration of the lifting cam 40 allows the lower edge portion 50 to slide under the chamfer of the bottom wall 52 until the inclined end wall 48 of the lifting cam 40 engages the chamfer thereby vertically lifting the indicator rod 18 As the wedge portion 38 is horizontally displaced toward the indicator rod 18. The maximum vertical elevation of the indicator rod 18 corresponds to the maximum lateral horizontal displacement of the wedge portion 38. The vertical elevation of the indicator rod 18 is promoted by an aperture 56 in a first arm member 58 of the press bed engagement member 42 of the compensator 16. The aperture 56 allows the lifting cam 40 to travel through the first arm member 58 until the lower edge portion 50 of the lifting cam 40 is vertically aligned with a side wall 60 of the press bed engagement member 42.

Figure 6:
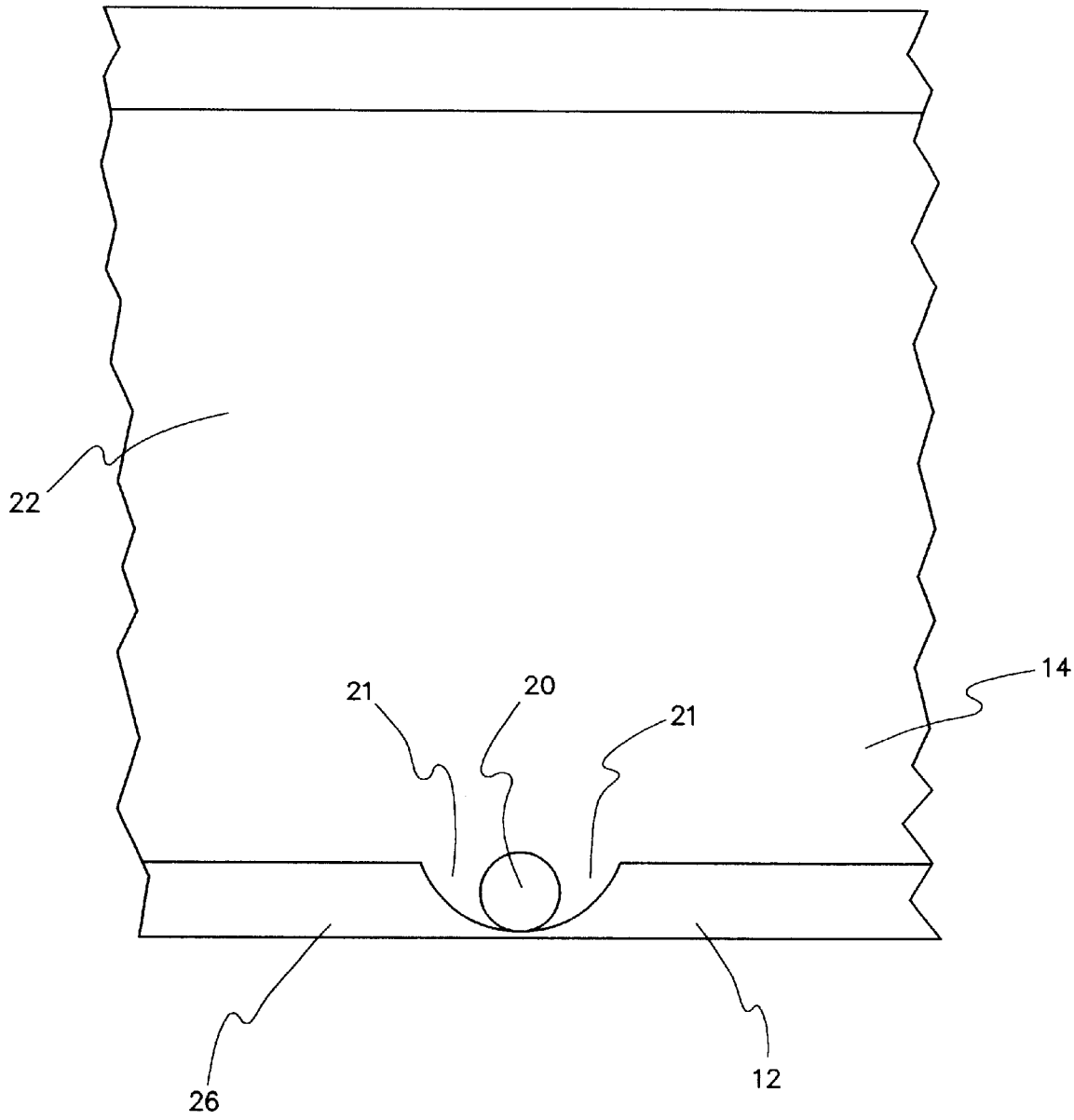
FIG. 6 is a bottom elevation view of a die holder member of the press brake compensator, the view depicting the proximate location of a first recess of the device in accordance with the present invention.
Figure 7:
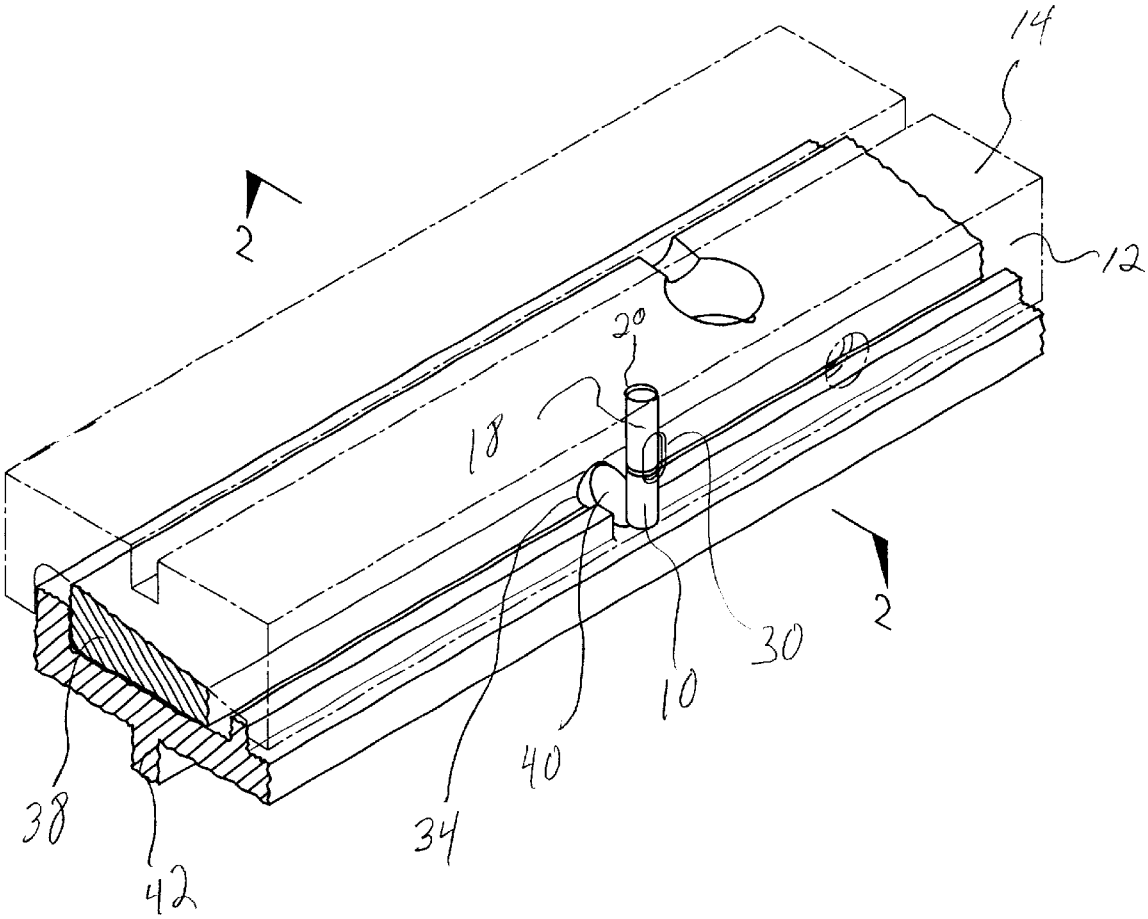
FIG. 7 is a perspective view of an assembled displacement indicator device and press brake compensator with the die holder member depicted in a phantom view.
Figure 8:
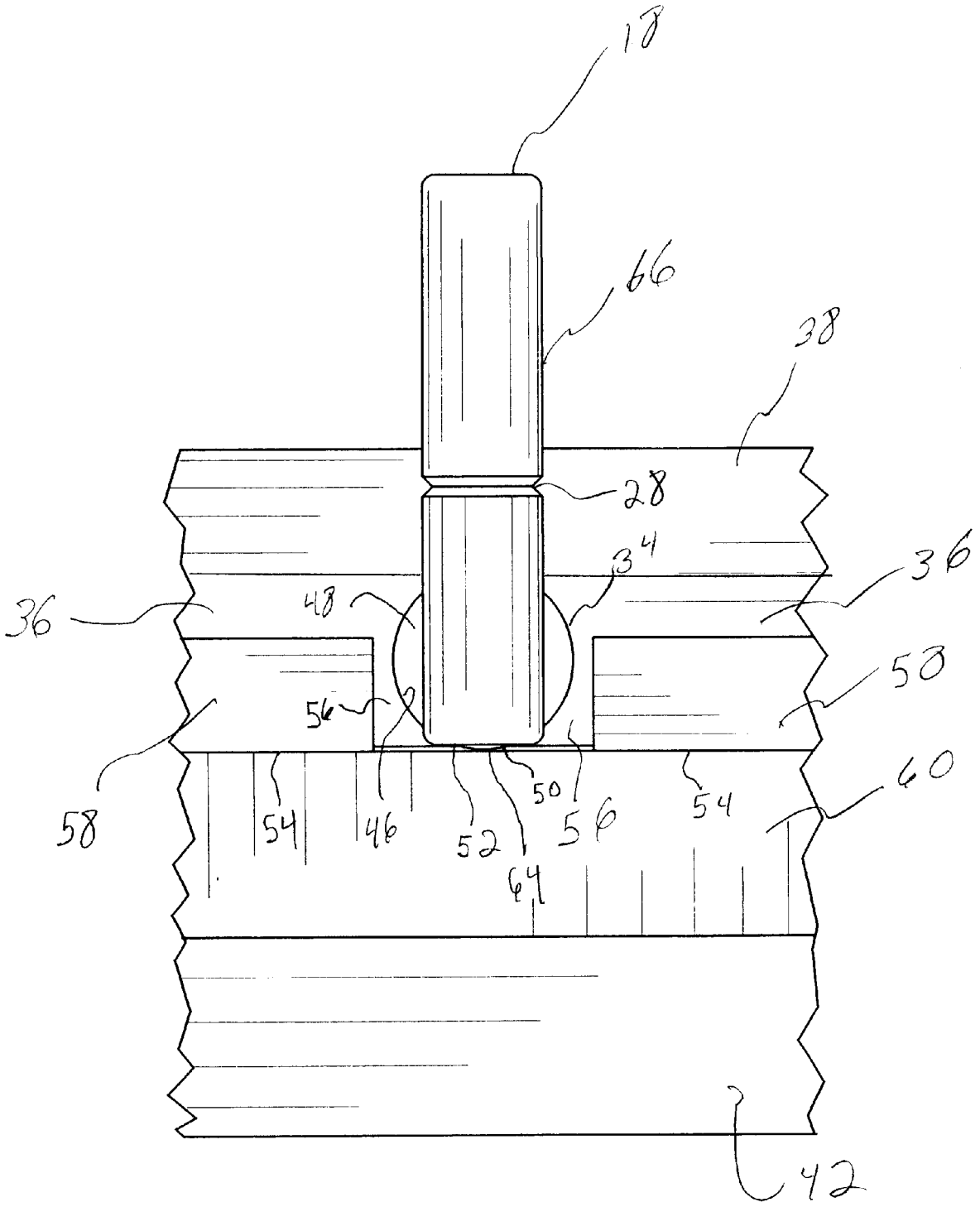
FIG. 8 is a cut-away, front elevation view of the device of FIG. 4 with the die holder member removed.

Referring to FIG. 6, the first aperture 20 (or recess 25) is positioned adjacent to the first side wall 12 of the die holder member 14 such that the longitudinal axis of the first aperture 20 is parallel to the first side wall 12. The first aperture 20 position is promoted by boring a substantially oval configured recess 21 into the inner arm member 26 of the die holder member 14 thereby allowing the first aperture 20 to extend between the lower and upper walls 22 and 24 of the die holder member 14 (or allowing a recess 25 to extend from the lower wall 22 to a predetermined depth corresponding to maximum vertical elevation of the indicator rod 18). The lifting cam 40 is positioned (see FIG. 2) such that the lower edge portion 50 is adjacent to the planar surface of the bottom wall 52 of the indicator rod 18 when the bottom wall 52 engages the ledge 54 of the press bed engagement member 42.

In operation, one or more displacement indication devices 10 for a press brake compensator 16 are positioned at predetermined locations in the compensator 16 to measure the vertical displacement of predetermined portions of a die holder member 14 of the compensator; the vertical displacement of the device 10 corresponding to the horizontal displacement of a wedge portion 38 of the compensator 16. A first aperture 20 or recess 25 is provided in a lower wall 22 of the die holder member 14 at the predetermined location. An indicator rod 18 is snugly inserted into the first aperture 20. Alternatively, a spring 27 may be inserted in the first recess 25 followed by the rod 18 which ultimately compresses the spring; whereupon, the spring 27 biases the indicator rod 18 downward to forcibly engage the upper wall 62 of the press bed engagement member 42. A second recess 34 is positioned in a side wall 36 of a wedge portion 38 of the press brake compensator 16. The second recess 34 and the first aperture 20 are cooperatively positioned at a longitudinal mid-portion of the compensator 16. A lifting cam 40 is snugly inserted into the second recess 34.

The indicator device 10 and press brake compensator 16 are assembled in a non-elevated position as detailed in FIG. 2. The wedge portion 38 orientates the lifting cam 40 such that a relatively long side 64 of a second portion 46 of the lifting cam 40 engages an upper wall 62 of a press bed engagement member 42. The long side 64 of the second portion 46 extends to a chamfered bottom wall 52 of the indicator rod 18, the bottom wall 52 engaging a ledge portion 54 of the press bed engagement member 42. An edge portion 50 of the lifting cam 40 is positioned adjacent to the bottom wall 52.

The press brake compensator 16 elevates predetermined portions of a die positioned in the die holder member 14. The indicator device 10 vertically displaces the indicator rod 18 (see FIG. 3) a distance equal to the horizontal displacement of the wedge portion 38 due to the forty-five degree slope of the inclined end wall 48 of the second portion 46 of the lifting cam 40. The chamfered perimeter of the bottom wall 52 permits the lower edge portion 50 of the lifting cam 40 to extend slightly under the cylindrical side wall 66 of the indicator rod 18 thereby permitting continued horizontal movement of the lifting cam 40 and allowing the inclined end wall 48 to engage a perimeter portion of the bottom wall 52 to ultimately elevate the lifting rod 18. The horizontal movement of the lifting cam 40 continues through an aperture 56 in a first arm member 58 of the press bed engagement member 42 until the lower edge portion 50 of the lifting cam 40 is vertically aligned with a side wall 60 of the press bed engagement 42; whereupon, the indicator rod 18 reaches a maximum vertical elevation which is measured by horizontally aligning a radial reference mark 28 on the indicator rod 18 with markings on an indicating scale 32 positioned adjacent to a viewing aperture 30 which allows an individual to constantly view the reference mark 28 during operation of the displacement indicator device 10. It should be noted that the slope (forty-five degrees) of the inclined end wall 48 of the lifting 40 is much "steeper" than the slope (ten degrees) of the wedge portion 38. The difference in slopes results in the indicator rod 18 being vertically elevated faster than the vertical elevation of the die holder member 14. The individual operating a press brake needs to know the vertical elevation or displacement of the die holder member 14. Thus, the indicating scale 32 is calibrated to measure the displacement of the die holder member 14 (not the displacement of the indicator rod 18) when the reference mark 28 on the rod 18 is aligned with a horizontal line and corresponding displacement number in the indicating scale 32.

The foregoing description is for purposes of illustration only and is not intended to limit the scope of protection accorded this invention. The scope of protection is to be measured by the following claims, which should be interpreted as broadly as the inventive contribution permits.

What is claimed is:

1. A displacement indicator device for a preselected portion of a die holder member of a press brake compensator comprising:

a lifting cam that cooperatively engages a predetermined portion of the press brake compensator, said lifting cam ultimately being displaced via a movement of the predetermined portion of the press brake compensator;

an indicator rod that cooperatively engages said lifting cam, said indicator rod being displaced by said lifting cam a distance corresponding to the movement of the predetermined portion of the press brake compensator; and means for indicating the displacement of the preselected portion of the die holder member of the press brake compensator.

2. The device of claim 1 wherein said indicator rod includes chamfered ends.

3. The device of claim 1 wherein said lifting cam includes a cylindrical first portion inserted in a recess in the wedge portion, and a relatively larger cylindrical second portion having an inclined end wall.

4. The device of claim 3 wherein said inclined end wall forms an angle of forty-five degrees with the longitudinal axis of said lifting cam.

5. The device of claim 1 wherein said lifting cam protrudes through an aperture in a first arm member of a press bed engagement member of the press brake compensator.

6. The device of claim 1 wherein said lifting cam includes a configuration that moves said indicator rod via a lower beveled end while a bottom wall of said indicator rod engages a ledge of a press bed engagement member of the press brake compensator.

7. The device of claim 1 wherein said indicator rod is inserted in a recess in a lower wall of a preselected portion of a die holder member of the press brake compensator.

8. The device of claim 7 wherein a biasing spring is inserted into said recess prior to inserting said indicator rod into said recess whereby said indicator rod is biased to forcibly engage said lifting cam.

9. The device of claim 7 wherein said recess is disposed adjacent to a first side wall of the die holder member such that the longitudinal axis of said recess is parallel to the first side wall.

10. The device of claim 1 wherein said lifting cam is disposed such that a lower edge of said lifting cam engages a lower chamfered end of said indicator rod while a bottom wall of said indicator rod engages a ledge of a press bed engagement member of the press brake compensator.

11. The device of claim 1 wherein said indicator rod includes a radial reference mark.

12. The device of claim 11 wherein said radial reference mark circumscribes said indicator rod.

13. The device of claim 1 wherein said indicating means includes an aperture in a first side wall of the die holder member, said aperture cooperates with a lifting cam receiving recess to allow a person to view said indicator rod.

14. The device of claim 13 wherein said aperture is configured to allow a person to view a marking on said indicator rod irrespective of the displacement of said indicator rod.

15. The device of claim 14 wherein said indicating means includes an indicating scale disposed adjacent to said aperture such that the position of said marking on said indicator rod cooperates with said indicating scale to provide the displacement of the corresponding portion of the die holder member of the press brake compensator.

16. The device of claim 15, wherein said indicating scale is numbered in units of hundredths of an inch.

17. The device of claim 1 wherein said indicator rod is inserted in an aperture extending through a preselected portion of a die holder member of the press brake compensator whereby a bottom wall of a lower chamfered end of said indicator rod engages a ledge of a press bed engagement member of the press brake compensator.

18. The device of claim 17 wherein said aperture is disposed adjacent to a first side wall of the die holder member such that the longitudinal axis of said aperture is parallel to the first side wall.

19. A device for measuring the displacement of a preselected portion of a die holder member of a press brake compensator comprising:

an indicator rod;

means for vertically moving said indicator rod correspondingly with a lateral movement of a predetermined portion of the press brake compensator; and means for indicating the displacement of the preselected portion of the die holder member of the press brake compensator via the vertical movement of said indicator.

20. A method for measuring the displacement of a preselected portion of a die holder member of a press brake compensator, said method comprising the steps of:

providing indicator means;

vertically moving said indicator means relative to a lateral movement of a preselected portion of the press brake compensator; and indicating the displacement of the preselected portion of the die holder member of the press brake compensator via the vertical movement of said indicator means.

* * * * *